US009580210B2

(12) United States Patent
Wegelin et al.

(10) Patent No.: US 9,580,210 B2
(45) Date of Patent: Feb. 28, 2017

(54) SYSTEM FOR TRACKING DISPENSE EVENTS

(71) Applicant: GOJO Industries, Inc., Akron, OH (US)

(72) Inventors: Jackson William Wegelin, Stow, OH (US); Matthew Joseph Archer, Aurora, OH (US); Chip Curtis, West Dundee, IL (US)

(73) Assignee: GOJO INDUSTRIES, INC., Akron, OH (US)

( * ) Notice: Subject to any disclaimer, the term of this patent is extended or adjusted under 35 U.S.C. 154(b) by 1 day.

(21) Appl. No.: 14/682,230

(22) Filed: Apr. 9, 2015

(65) Prior Publication Data

US 2015/0291314 A1 Oct. 15, 2015

Related U.S. Application Data

(60) Provisional application No. 61/977,553, filed on Apr. 9, 2014.

(51) Int. Cl.
*B65D 25/20* (2006.01)
*G08B 21/24* (2006.01)

(52) U.S. Cl.
CPC ..... *B65D 25/20* (2013.01); *G08B 21/24* (2013.01)

(58) Field of Classification Search
CPC ..... G08B 23/00; G08B 21/24; B65D 25/20
USPC ... 340/573.1, 573.4, 440.1, 657, 687, 691.1; 700/236, 241, 244; 222/105, 162
See application file for complete search history.

(56) References Cited

U.S. PATENT DOCUMENTS 6,271,753 B1 * 8/2001 Shukla ..... B65D 55/028 340/545.6
6,392,546 B1 * 5/2002 Smith ..... G08B 21/245 222/105
7,844,362 B2 * 11/2010 Handfield ..... A61J 7/0084 700/236
8,067,935 B2 * 11/2011 Burrows ..... A61J 7/0481 206/534
8,350,706 B2 1/2013 Wegelin et al.
8,844,766 B2 * 9/2014 Zaima ..... A61L 2/26 222/162
2008/0114490 A1 5/2008 Jean-Pierre
(Continued)

OTHER PUBLICATIONS

Int. Search Report/Written Opinion cited in PCT Application No. PCT/US2015/025049 dated Jul. 8, 2015, 13 pgs.

*Primary Examiner* — Tai Nguyen
(74) *Attorney, Agent, or Firm* — Cooper Legal Group, LLC

(57) ABSTRACT

A dispensing system includes a container within which a material is contained. The dispensing system includes a nozzle, attached to the container, having a first portion and a second portion. The dispensing system includes a magnet attached to the first portion and a compliance system attached to the second portion. The compliance system includes a transmitter and a magnet sensor, coupled to the transmitter, for detecting a presence of the magnet when the first portion with respect to the second portion is in a closed position, and for detecting a non-presence of the magnet when the first portion with respect to the second portion is in an opened position. The transmitter transmits a wireless compliance signal indicative of the magnet sensor detecting at least one of the presence or the non-presence of the magnet.

20 Claims, 6 Drawing Sheets

(56) References Cited

U.S. PATENT DOCUMENTS

| | | | | |
|---|---|---|---|---|
| 2011/0180563 | A1* | 7/2011 | Fitchett | B67D 3/0051 222/1 |
| 2012/0274468 | A1 | 11/2012 | Wegelin et al. | |

* cited by examiner

SYSTEM FOR TRACKING DISPENSE EVENTS

CROSS-REFERENCE TO RELATED APPLICATIONS

This application claims priority to U.S. Provisional Patent Application No. 61/977,553, filed on Apr. 9, 2014, the entire disclosure of which is hereby incorporated by reference.

TECHNICAL FIELD

The instant application is generally directed towards a dispensing system. For example, the instant application is directed towards a dispensing system having a compliance system for tracking dispense events.

BACKGROUND

Dispensing systems can dispense a sanitizing material to a user. Dispensing systems can be used, for example, in schools, hospitals, nursing homes, factories, restaurants, etc.

SUMMARY

This summary is provided to introduce a selection of concepts in a simplified form that are further described below in the detailed description. This summary is not intended to identify key factors or essential features of the claimed subject matter, nor is it intended to be used to limit the scope of the claimed subject matter.

In an example, a dispensing system comprises a dispensing system comprising a container within which a material is contained and from which the material is dispensed. The dispensing system comprises a nozzle attached to the container. The nozzle comprises a first portion and a second portion wherein at least one of the first portion is movable with respect to the second portion or the second portion is movable with respect to the first portion such that a position of the first portion with respect to the second portion is movable between an opened position, in which the material from the container is dispensed through an opening in the nozzle, and a closed position, in which the material from the container is not dispensed through the opening in the nozzle. The dispensing system comprises a magnet attached to the first portion of the nozzle and a compliance system attached to the second portion of the nozzle. The compliance system comprises a transmitter and a magnet sensor, coupled to the transmitter, configured to detect a presence of the magnet when the first portion of the nozzle with respect to the second portion of the nozzle is in the closed position, and configured to detect a non-presence of the magnet when the first portion of the nozzle with respect to the second portion of the nozzle is in the opened position. The transmitter is configured to transmit a wireless compliance signal indicative of the magnet sensor detecting at least one of the presence or the non-presence of the magnet.

In another example, a dispensing system comprises a kit for converting a dispensing system into a compliance dispensing system. The kit comprises a magnet configured to be attached to a first portion of a nozzle of the dispensing system. The kit comprises a compliance system configured to be attached to a second portion of the nozzle of the dispensing system. The compliance system comprises a transmitter and a magnet sensor, coupled to the transmitter, configured to detect a presence of the magnet when the first portion of the nozzle with respect to the second portion of the nozzle is in a closed position, and configured to detect a non-presence of the magnet when the first portion of the nozzle with respect to the second portion of the nozzle is in an opened position. The transmitter is configured to transmit a wireless compliance signal indicative of the magnet sensor detecting at least one of the presence or the non-presence of the magnet.

In another example, a dispensing system comprises a container within which a material is contained and from which the material is dispensed. The dispensing system comprises a nozzle attached to the container. The nozzle comprises a first portion and a second portion wherein at least one of the first portion is movable with respect to the second portion or the second portion is movable with respect to the first portion such that a position of the first portion with respect to the second portion is movable between an opened position, in which the material from the container is dispensed through an opening in the nozzle, and a closed position, in which the material from the container is not dispensed through the opening in the nozzle. The dispensing system comprises a switch attached to the second portion of the nozzle. The switch is configured to engage the first portion of the nozzle when the second portion of the nozzle with respect to the first portion of the nozzle is in the closed position. The switch is not configured to engage the first portion of the nozzle when the second portion of the nozzle with respect to the first portion of the nozzle is in the opened position. The dispensing system comprises a compliance system attached to one of the first portion of the nozzle or the second portion of the nozzle. The compliance system comprises a transmitter that is coupled to the switch. The transmitter is configured to transmit a wireless compliance signal when the switch does not engage the first portion of the nozzle and the nozzle is in the opened position.

The following description and annexed drawings set forth certain illustrative aspects and implementations. These are indicative of but a few of the various ways in which one or more aspects can be employed. Other aspects, advantages, and/or novel features of the disclosure will become apparent from the following detailed description when considered in conjunction with the annexed drawings.

DETAILED DESCRIPTION

Figure 1:
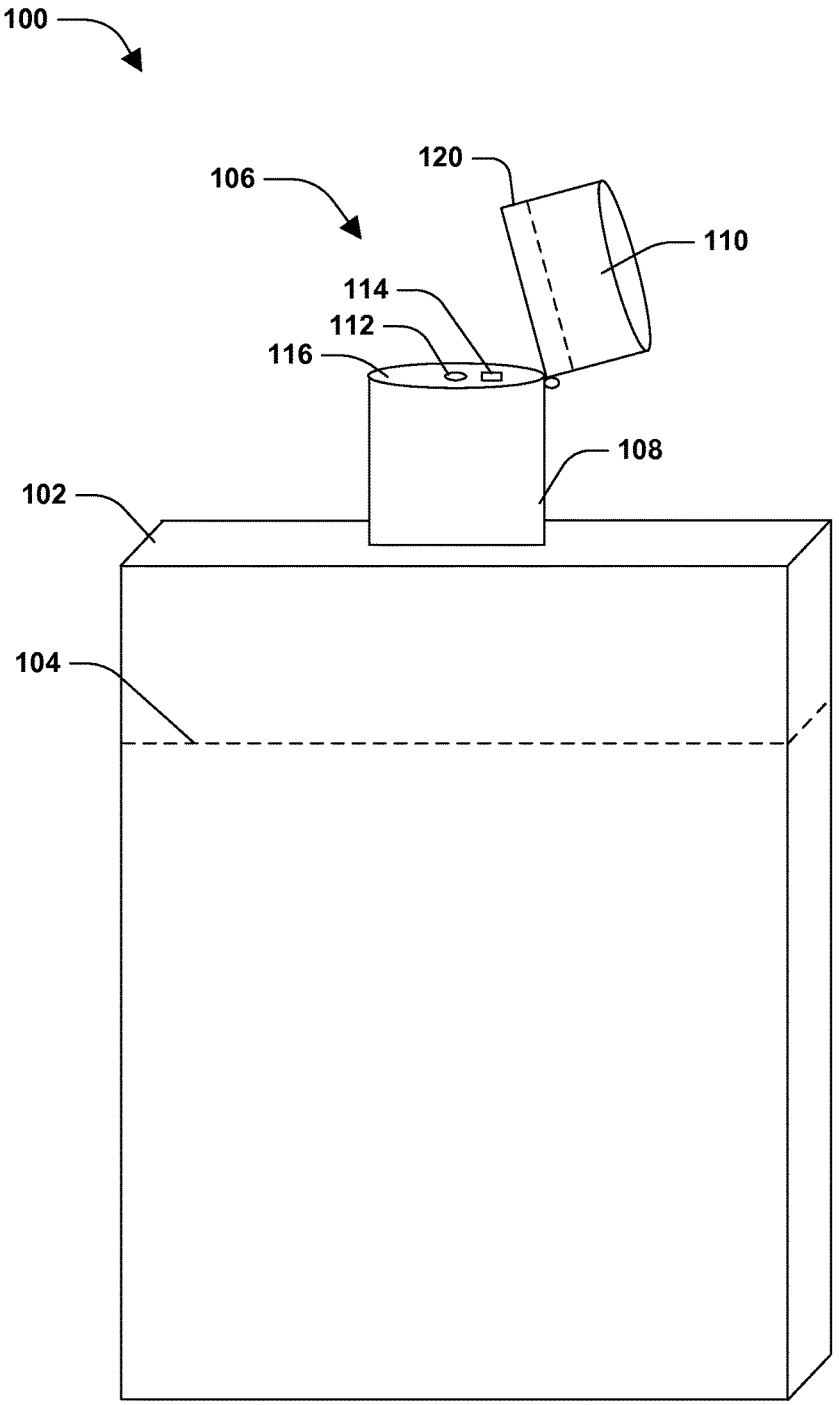
FIG. 1 is an illustration of an example dispensing system.

The claimed subject matter is now described with reference to the drawings, wherein like reference numerals are generally used to refer to like elements throughout. In the following description, for purposes of explanation, numerous specific details are set forth in order to provide an understanding of the claimed subject matter. It is evident, however, that the claimed subject matter can be practiced without these specific details. In other instances, structures and devices are illustrated in block diagram form in order to facilitate describing the claimed subject matter.

Turning to FIG. 1, a dispensing system 100 is illustrated. In an example, the dispensing system 100 can be used for storing and/or dispensing a material. The dispensing system 100 may have at least some degree of portability, movability, transferability, etc., such that the dispensing system 100 can be held and/or carried by a user. In some examples, the dispensing system 100 may be pocket sized, such that the user can selectively store the dispensing system 100 in his or her pocket. In other possible examples, the dispensing system 100 may be larger.

The dispensing system 100 can include a container 102. In an example, the container 102 can contain and dispense a material 104 that is stored within the container 102. The container 102 can define an interior in which the material 104 is stored. The container 102 includes any number of sizes, shapes, constructions, configurations, etc. For example, the container 102 includes any variety of shaped bottles capable of receiving nearly any quantity of the material 104.

The material 104 includes any type of liquid, semi-liquid, gel, powder, foam based materials, etc. The material 104 can include, for example, hygiene products and cleaning materials such as disinfectants, sanitizers, antiseptics, soaps, moisturizers, or the like. In other examples, the material 104 may include water or other non-cleaning liquid materials. Indeed, the material 104 is not specifically limited to these examples, and could include any type of materials.

The dispensing system 100 may include a nozzle 106 attached to the container 102. The nozzle 106 can be attached to the container 102 in any number of ways, such as by screwing/threading, locking structures, snap fit structures, or the like. The nozzle 106 may be positioned at an end (e.g., upper end) of the container 102, though, in other examples, the nozzle 106 may be positioned/attached to a sidewall of the container 102, a bottom wall of the container 102, etc. In an example, the nozzle 106 provides for selective dispensing of the material 104 from the container 102.

Though the nozzle 106 may comprise any number of possible constructions and/or configurations, in the illustrated example, the nozzle 106 includes a first portion 108 and a second portion 110. In this example, the first portion 108 of the nozzle 106 is substantially non-movable and may be attached, fastened, and/or fixed to the container 102. Similarly, in this example, the second portion 110 of the nozzle 106 may be movable with respect to the first portion 108 of the nozzle 106. Indeed, the second portion 110 may comprise a lid, cover, cap, or other similar movable covering structure. As such, the second portion 110 may move with respect to the first portion 108 to allow for selective opening and closing of the nozzle 106.

In an example, at least one of the first portion 108 is movable with respect to the second portion 110 or the second portion 110 is movable with respect to the first portion 108. It will be appreciated that the respective portions of the nozzle 106 (e.g., the first portion 108 and the second portion 110) are not limited to the example of FIG. 1. Indeed, in other possible examples, the first portion 108 of the nozzle 106 comprises the lid, cover, cap or other similar movable covering structure. Similarly, in such an example, the second portion 110 of the nozzle 106 is generally non-movable and may be attached/fastened/fixed to the container 102.

The nozzle 106 comprises an opening 112 extending through the first portion 108. The opening 112 defines a channel, space, hole, or the like, such that the material 104 can be dispensed through the opening 112 in the nozzle 106. As such, when the nozzle 106 is moved to the opened position (e.g., by moving the second portion 110 with respect to the first portion 108), the material 104 can be dispensed through the opening 112 to the user. When the user no longer desires the material, such as after a dispense event has happened, the user may move the nozzle 106 to the closed position.

The dispensing system 100 may include a magnet 114 attached to the first portion 108 of the nozzle 106. The magnet 114 comprises any number of sizes/shapes. In an example, the magnet 114 may be attached to a surface 116 (e.g., upper surface) of the first portion 108 of the nozzle 106. The surface 116 in this example faces away from the container 102. The magnet 114 may be positioned in proximity to the opening 112, such as adjacent to the opening 112. In other examples, the magnet 114 may be positioned farther away from the opening 112, such as along an outer radial edge of the surface 116. In further examples, the magnet 114 may be positioned along a sidewall of the first portion 108 of the nozzle 106, or the like.

The dispensing system 100 may include a compliance system 120 attached to the second portion 110 of the nozzle 106. In general, the compliance system 120, illustrated generically/schematically in FIG. 1, can be used to track and/or monitor the number of times that dispense events occur. A dispense event may occur when the user opens the nozzle 106, such as by moving the second portion 110 with respect to the first portion 108 into the opened position. Tracking the number of dispense events with the compliance system 120 may be beneficial so as to comply with hygiene protocols and procedures that ensure that personnel are adopting habits that are efficacious in the prevention of disease transmission. Indeed tracking the number of dispense events with the compliance system 120 may be beneficial in a number of different environments, including, but not limited to, hospitals, schools, nursing homes, restaurants, factories, etc.

The compliance system 120 can be attached in any number of ways to the second portion 110 of the nozzle 106. For example, the compliance system 120 can be attached by mechanical fasteners (e.g., nuts, bolts, screws, etc.), adhesives, snap fit and/or locking structures, or the like. In an example, the compliance system 120 may be attached to an upper surface of the second portion 110 of the nozzle 106. In other examples, however, the compliance system 120 may be attached to a sidewall of the second portion 110 of the nozzle, to a lower surface (e.g., facing the container 102) of the second portion 110, etc.

It will be appreciated that the respective locations/positions of the magnet 114 and the compliance system 120 are not limited to the illustrated example of FIG. 1. Indeed, in other possible examples, the respective locations/positions of the magnet 114 and the compliance system 120 may be reversed. For example, the magnet 114 may be attached to the second portion 110 of the nozzle 106. Similarly, the compliance system 120 may be attached to the first portion 108 of the nozzle 106.

Figure 2:
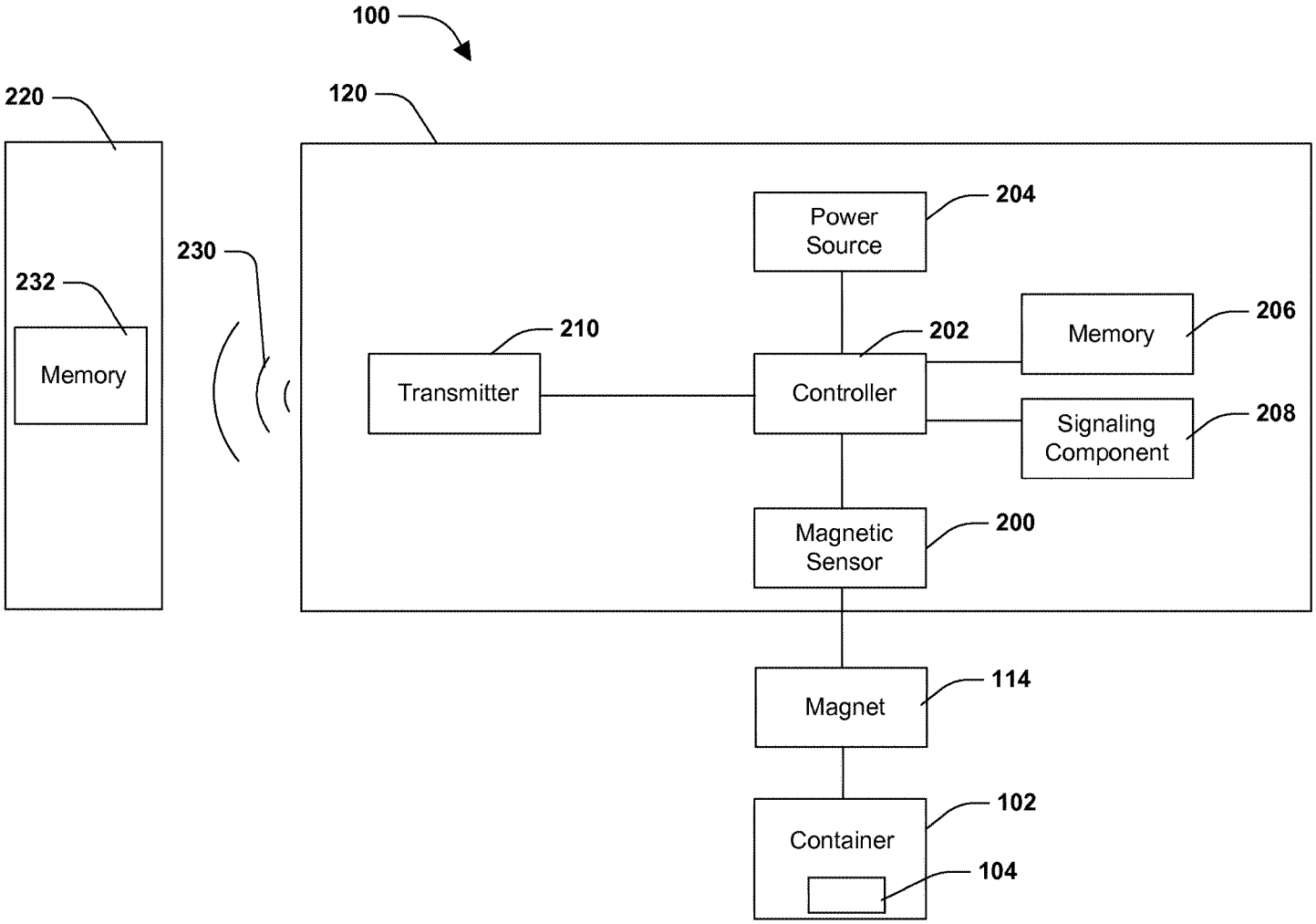
FIG. 2 is an illustration of an example dispensing system.

Turning to FIG. 2, an example of the compliance system 120 is illustrated. The compliance system 120 may include a magnet sensor 200. The magnet sensor 200 can detect a presence of the magnet 114 when the first portion 108 of the nozzle 106 with respect to the second portion 110 of the nozzle 106 is in the closed position. The magnet sensor 200 can detect the non-presence of the magnet 114 when the first portion 108 of the nozzle 106 with respect to the second portion 110 of the nozzle 105 is in the opened position. For example, the magnet sensor 200 can include a Hall effect magnet sensor. In an example, the magnet sensor 200 is configured to detect the proximity of the magnet 114 with respect to the magnet sensor 200. When the magnet 114 is greater than a predetermined distance away from the magnet sensor 200, the magnet sensor 200 can detect this non-presence of the magnet 114. In the case of a Hall effect magnet sensor 200, the magnet sensor 200 may vary its voltage output in response to the changing magnetic field (e.g., the magnet 114 being greater than a predetermined distance from the magnet sensor 200).

The compliance system 120 may include a controller 202. The controller 202 is coupled to the magnet sensor 200 and may receive signal(s) from the magnet sensor 200 indicative of the magnet sensor 200 detecting the presence and/or non-presence of the magnet 114. The controller 202 can include a logic controller (e.g., microcontroller, etc.) and may be coupled to the second portion 110 of the nozzle 106.

The compliance system 120 may include a power source 204. The power source 204 is coupled to the controller 202. The power source 204 may power the controller 202, the magnet sensor 200, etc. The power source 204 comprises any number of structures that can provide power, such as batteries, solar cells, or the like.

The compliance system 120 may include memory 206. The memory 206 is coupled to the controller 202 and to the magnet sensor 200. The memory 206 can store data from the magnet sensor 200, such as information related to the magnet sensor 200 detecting the presence and/or non-presence of the magnet 114. For example, the memory 206 can store a number of dispense events, wherein a dispense event corresponds to the magnet sensor 200 detecting the non-presence of the magnet 114 when the first portion 108 of the nozzle 106 with respect to the second portion 110 of the nozzle 106 is moved from the closed position to the opened position. In some examples, the memory 206 can be reset such that the number of dispense events stored within the memory 206 can be erased. The memory 206 can be reset/erased in any number of ways, such as by depressing a button, switch or the like, in an example.

The compliance system 120 may include a signaling component 208. The signaling component 208 may be coupled to the controller 202, the magnet sensor 200 and/or to the memory 206. In an example, the signaling component 208 can emit a signal when the magnet sensor 200 detects the non-presence of the magnet 114 (e.g., when the nozzle 106 is moved from the closed position to the opened position) and/or when the dispense event is stored within the memory 206. The signaling component 208 includes any number of structures that can emit a visual and/or audible signal. In an example, the signaling component 208 comprises a light, such as one or more light emitting diodes (LEDs). In such an example, the signal emitted by the signaling component 208 comprises a light. In another example, the signaling component 208 comprises a speaker or microphone, such that the signal emitted by the signaling component 208 comprises an audible noise, such as an alarm, beep, or the like. In other examples, the signaling component 208 may include both the visual device (e.g., LED(s)) and the audible device (e.g., speaker or microphone).

The compliance system 120 may include a transmitter 210. The transmitter 210 may be coupled to the controller 202, the memory 206, the magnet sensor 200, etc. The transmitter 210 can transmit or otherwise communicate signals, such as a hygiene compliance signal to a remote monitoring device 220. In an example, the transmitter 210 comprises a wireless transmitter, such that the transmitter 210 transmits/communicates wireless signals. In these examples, the transmitter 210 can transmit a wireless compliance signal 230 that is indicative of the magnet sensor 200 detecting the non-presence of the magnet 114. The transmitter 210 comprises any number of wireless devices, including Bluetooth, radio frequency (RF), infrared (IR), Wi-Fi, etc. As such, the wireless compliance signal(s) 230 may comprise Bluetooth signals, RF signals, infrared (IR) signals, etc.

The wireless compliance signal 230 can be transmitted to the remote monitoring device 220. In an example, the wireless compliance signal 230 can be transmitted from the compliance system 120 to the remote monitoring device 220 when the remote monitoring device 220 is brought into proximity with the compliance system 120. Data can be stored on the remote monitoring device 220 in a manner so that it can be later analyzed and/or transferred to another device (e.g., computing device) for analysis. In one possible example, data can be stored in memory 232 of the remote monitoring device 220. The memory 232 can include, for example, a portable memory unit such as a USB memory unit, SD memory unit, flash memory unit, flash memory, solid state hard drive, standard hard drive, removable hard drive, etc.

This data may be transferred from the remote monitoring device 220 (e.g., from the memory 232) to a compatible computing device for analysis of the data. For example, the hygiene compliance data may be processed for the generation of reports, for analysis, or for other reasons related to determining whether predetermined hygiene standards and protocols are being met.

In an example, a kit of parts may be provided for converting a dispensing system into a compliance dispensing system 100. In general, the kit may include the magnet 114 and the compliance system 120, including the magnet sensor 200, the controller 202, the power source 204, the memory 206, the signaling component 208, the transmitter 210, etc. The kit may be arranged in a similar manner as illustrated and described with respect to FIGS. 1 and 2. For example, the compliance system 120 may be attached to the second portion 110 of the nozzle 106 in a similar manner as described above. Similarly, the magnet 114 may be attached to the first portion 108 of the nozzle 106 in a similar manner as described above.

Figure 3:
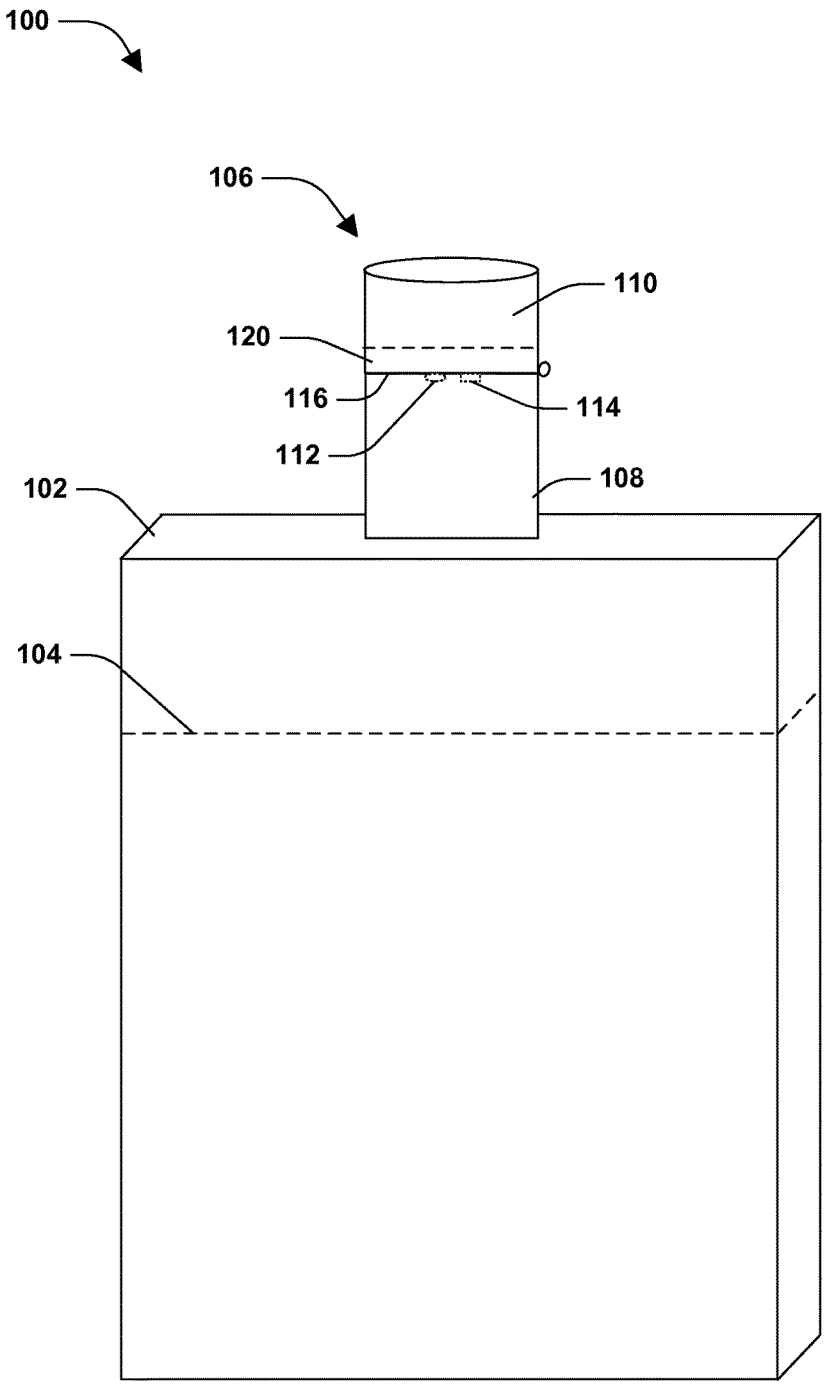
FIG. 3 is an illustration of an example dispensing system.

Turning to FIG. 3, an example operation of the dispensing system 100 is illustrated. In this example, the nozzle 106 may initially be in the closed position. For example, the position of the first portion 108 of the nozzle 106 with respect to the second portion 110 of the nozzle 106 is in the closed position. As such, the opening 112 is covered and the material 104 may not be dispensed through the opening 112 in the nozzle 106. When the nozzle 106 is in this closed position, the magnet sensor 200 may detect the presence of the magnet 114, in part, due to the relatively close proximity of the magnet 114 to the magnet sensor 200. The magnet sensor 200 may therefore detect that the nozzle 106 is in the closed position.

Figure 4:
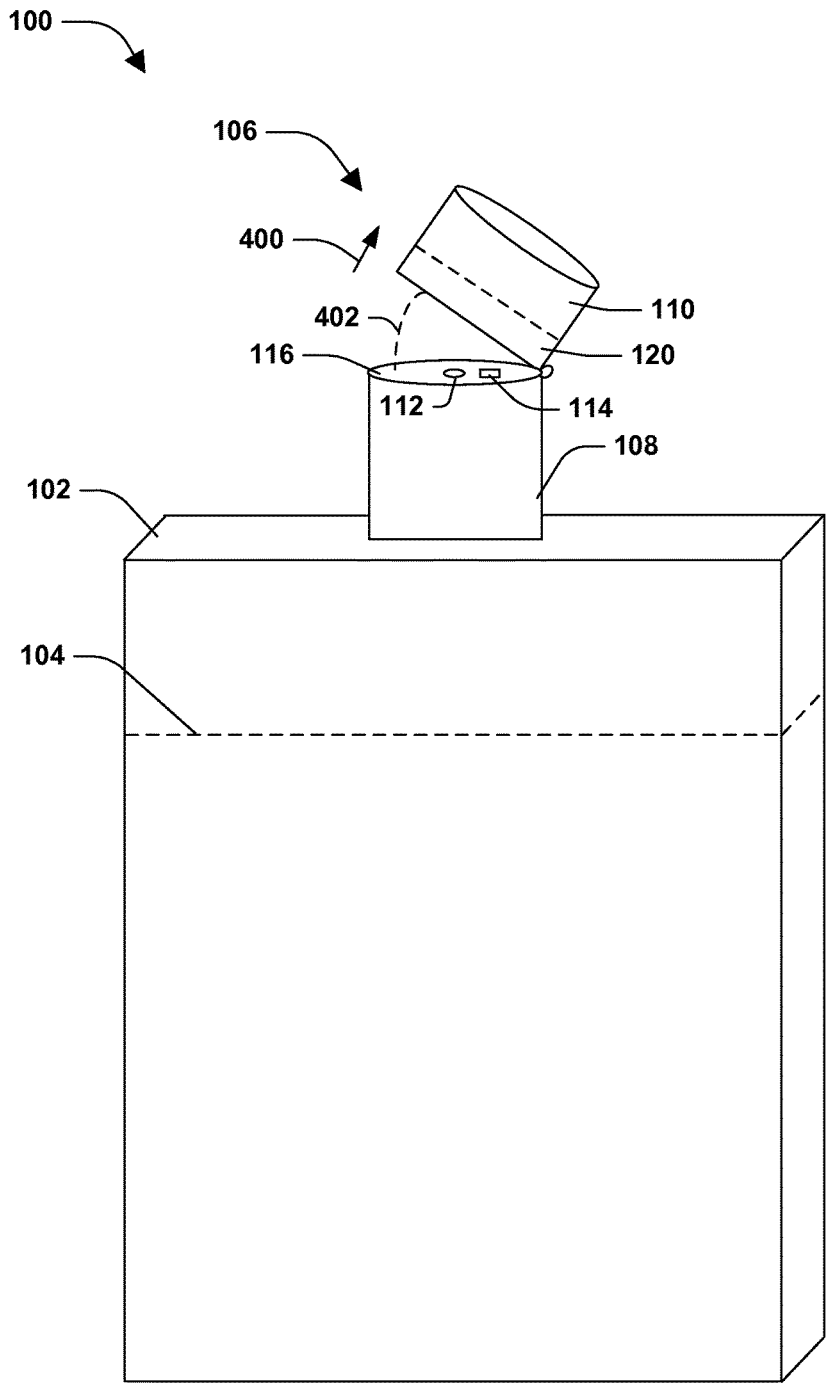
FIG. 4 is an illustration of an example dispensing system.

Turning to FIG. 4, the nozzle 106 may be moved to the opened position. For example, the second portion 110 of the nozzle 106 may be moved along a movement direction 400. As such, the position of the first portion 108 with respect to the second portion 110 is moved from the closed position to the opened position. It will be appreciated that the opened position is not specifically limited to the second portion 110 being fully opened (e.g., 90°) and separated from the first portion 108. Rather, in an example, in the opened position, the second portion 110 may form an angle 402 with respect to the first portion 108. In some examples, the nozzle 106 is in the opened position when the angle 402 is greater than about 30°. Such an angle 402 is not intended to be limiting, and in other examples, the angle 402 for which the nozzle 106 is opened maybe greater than or equal to about 40°, 45°, 50°, 55°, or 60°, etc.

In this example, when the second portion 110 of the nozzle 106 is moved to the opened position (e.g., greater than about 30°) with respect to the first portion 108, the material 104 can be dispensed through the opening 112 in the nozzle 106. In addition, in the illustrated opened position, the magnet sensor 200 may detect the non-presence of the magnet 114. For example, as the second portion 110 is moved away from the first portion 108, a distance between the magnet 114 and the magnet sensor 200 is increased to be greater than a predetermined distance. As such, the magnet sensor 200 can detect this non-presence of the magnet 114 and vary its voltage output in response. This non-presence of the magnet 114 can be tracked/recorded as a dispense event, since the opening of the nozzle 106 is indicative of a user dispensing the material 104 through the opening 112. Accordingly, the memory 206 may receive a signal from the magnet sensor 200 that is indicative of this dispense event, and store the number of dispense events that have occurred.

After the dispense event has occurred, the user may move the second portion 110 of the nozzle 106 with respect to the first portion 108 from the opened position (e.g., greater than about 30°) to the closed position (e.g., less than about 30°). After the nozzle 106 has been closed, the magnet sensor 200 may detect the presence of the magnet 114. In such an example, the magnet sensor 200 may be reset and/or disabled so as not to transmit a compliance signal or data. The magnet sensor 200 may again transfer compliance signal or data upon the nozzle 106 being re-opened.

To inhibit false positives and/or inadvertent tracking of dispense events, one or more features, structures, devices, or the like may be provided. In one possible example, a timer may be provided as part of the compliance system 120. In such an example, when the nozzle 106 is moved between the opened position and the closed position greater than a predetermined number of times within a predetermined time frame, then the dispense events may not be tracked. Indeed, such a situation may exist when the user is rapidly opening and closing the nozzle 106 for non-dispense event reasons.

After the number of dispense events has been tracked and stored by the compliance system 120, this information can be transmitted to the remote monitoring device 220 through the wireless compliance signal 230. For example, the transmitter 210 can transmit the wireless compliance signal 230 that is indicative of the number of times the nozzle 106 has been opened (e.g., number of dispense events). This wireless compliance signal 230 can be received by the remote monitoring device 220, whereupon the number of dispense events can be stored (e.g., within the memory 232), analyzed, or the like.

The dispensing system 100 provides a number of benefits. For example, since the dispensing system 100 includes the magnet 114 as part of a system for tracking dispense events, the magnet 114 is generally waterproof, such that the magnet 114 can be exposed to the material 104 with relatively little effect on the tracking of dispense events. Further, the compliance system 120 uses a relatively small amount of power, such that the compliance system 120 can be powered by a battery for a relatively long period of time.

Figure 5:
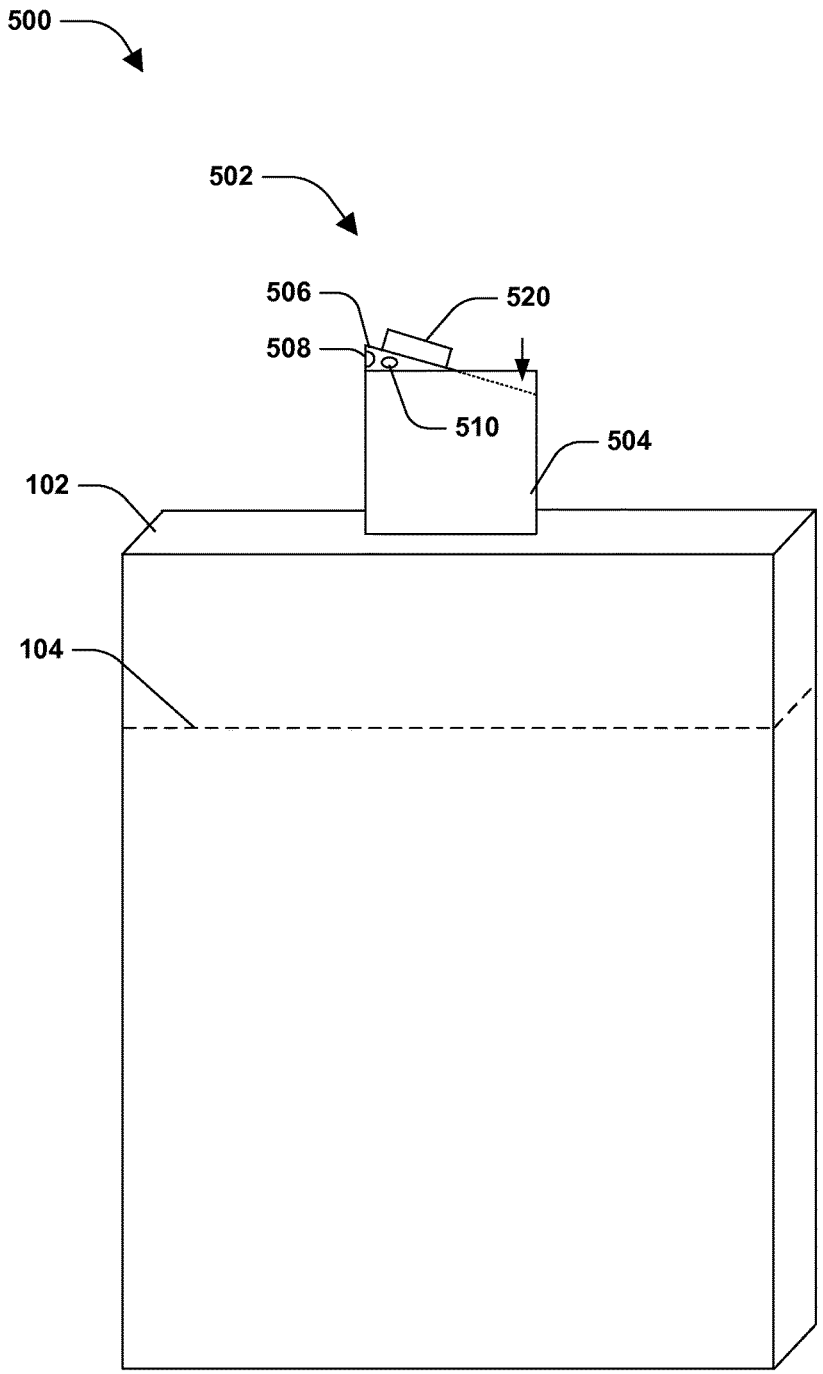
FIG. 5 is an illustration of an example dispensing system.

Turning to FIG. 5, a second example dispensing system 500 is illustrated. The second dispensing system 500 can include the container 102, the material 104, etc. In the illustrated example, the second dispensing system 500 comprises a nozzle 502. The nozzle 502 can be attached to the container 102 in any number of ways, such as by screw/threading, locking structures, snap fit structures, or the like. The nozzle 502 may be positioned at an end (e.g., upper end) of the container 102, though, in other examples, the nozzle 502 may be positioned/attached to a sidewall of the container 102, a bottom wall of the container 102, etc. In general, the nozzle 502 provides for selective dispensing of the material 104 from the container 102.

Though the nozzle 502 may comprise any number of possible constructions/configurations, in the illustrated example, the nozzle 502 includes a first portion 504 and a second portion 506. In this example, the first portion 504 of the nozzle 502 is generally non-movable and may be attached/fastened/fixed to the container 102. Similarly, in this example, the second portion 506 of the nozzle 502 may be movable with respect to the first portion 504 of the nozzle 502. As such, the second portion 506 may move with respect to the first portion 504 to allow for selective opening and closing of the nozzle 502.

In an example, at least one of the first portion 504 is movable with respect to the second portion 506 or the second portion 506 is movable with respect to the first portion 504. It will be appreciated that the respective portions of the nozzle 502 (e.g., the first portion 504 and the second portion 506) are not limited to the example of FIG. 5. Indeed, in other possible examples, the first portion 504 of the nozzle 106 comprises the movable lid, cover, etc. Similarly, in such an example, the second portion 506 of the nozzle 502 is generally non-movable and may be attached/fastened/fixed to the container 102.

The nozzle 106 comprises an opening 508 extending through the second portion 506. The opening 508 defines a channel, space, hole, or the like, such that the material 104 can be dispensed through the opening 508 in the nozzle 502. As such, when the nozzle 502 is moved to the opened position (e.g., by moving the second portion 506 with respect to the first portion 504), the material 104 can be dispensed through the opening 508 to the user. When the user no longer desires the material, such as after a dispense event has happened, the user may move the nozzle 502 to the closed position.

The second dispensing system 500 comprises a switch 510 attached to the second portion 506 of the nozzle 502. The switch 510 is configured to engage the first portion 504 of the nozzle 502 when the second portion 506 of the nozzle 502 with respect to the first portion 504 of the nozzle 502 is in the closed position. Along these lines, the switch 510 may not engage the first portion 504 of the nozzle 502 when the second portion 506 of the nozzle 502 with respect to the first portion 504 of the nozzle 502 is in the opened position.

The switch 510 comprises any number of switches. For example, the switch 510 may include a button/push-button switch or other similar electromechanical or electrical switches. In general, the switch 510 may function to open or close a circuit. For example, when the nozzle 502 is in the closed position, the switch 510 may contact electrical contacts or the like on the first portion 504, such that a circuit is closed. Similarly, when the nozzle 502 is in the opened position, the switch 510 may not contact the electrical contacts on the first portion 504, such that a circuit is open. In these examples, when the nozzle 502 is moved from the closed position to the opened position, the switch 510 may detect such movement and track this movement as a dispense event.

Figure 6:
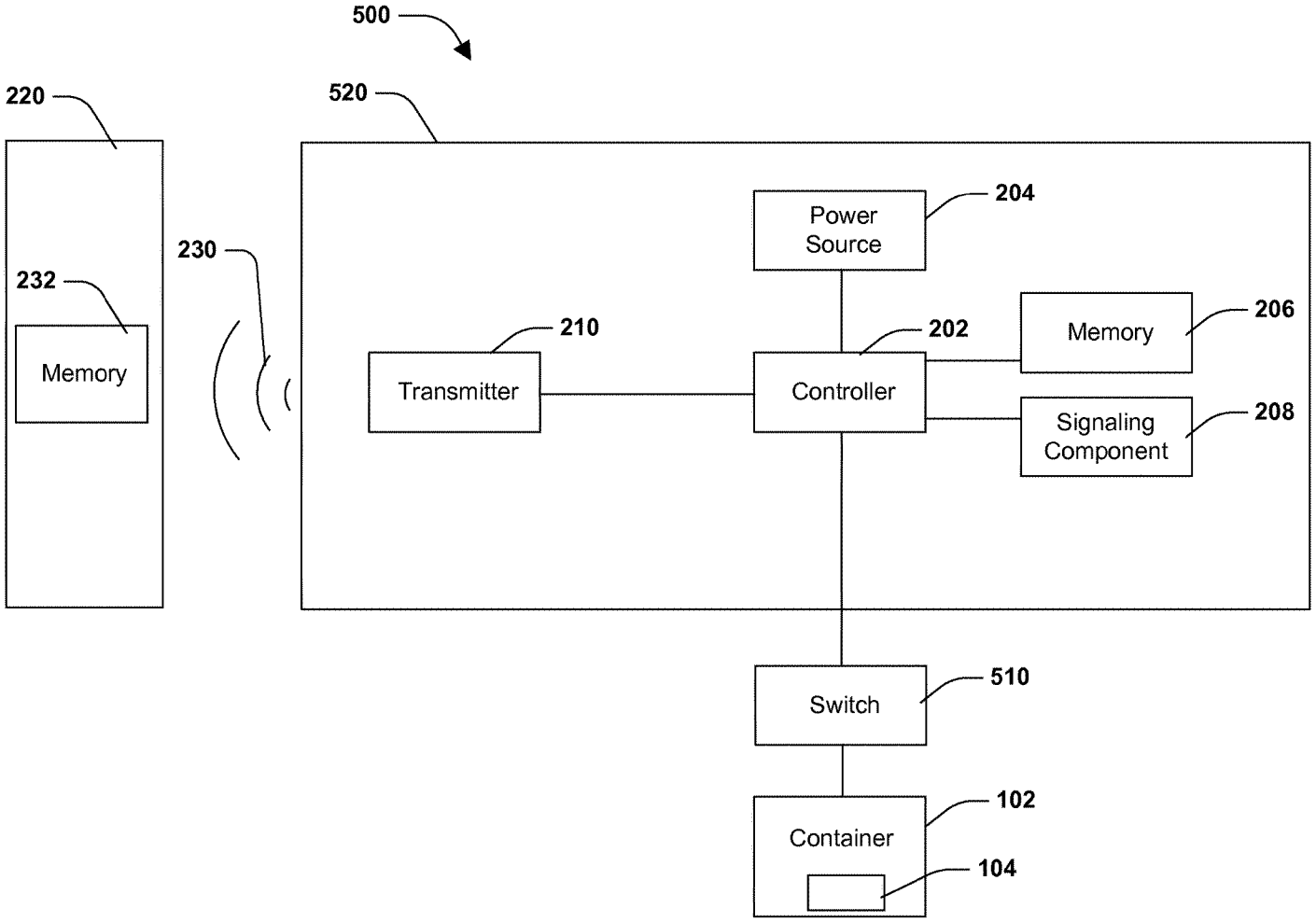
FIG. 6 is an illustration of an example dispensing system.

Referring to FIGS. 5 and 6, the second dispensing system 500 may include a compliance system 520 attached to one of the first portion 504 of the nozzle 502 or the second portion 506 of the nozzle 502. In general, the compliance system 520 can be used to track and/or monitor the number of times that dispense events occur. A dispense event may occur when the user opens the nozzle 502, such as by moving the second portion 506 with respect to the first portion 504 into the opened position. Tracking the number of dispense events with the compliance system 520 may be beneficial so as to comply with hygiene protocols and procedures that ensure that personnel are adopting habits that are efficacious in the prevention of disease transmission.

The compliance system 520 may be similar in some respects to the compliance system 120 of FIG. 2. For example, the compliance system 520 may include the controller 202, the power source 204, the memory 206, the signaling component 208, the transmitter 210. The compliance system 520 may communicate with the remote monitoring device 220, which includes the memory 232, by transmitting the wireless compliance signal 230 to the remote monitoring device 220.

The switch 510 may be coupled to the controller 202 of the compliance system 520. In operation, the nozzle 502 may initially be in the closed position. For example, the position of the first portion 504 of the nozzle 502 with respect to the second portion 506 of the nozzle 502 is in the closed position. As such, the opening 508 is covered and the material 104 may not be dispensed through the opening 508 in the nozzle 502. When the nozzle 502 is in this closed position, the switch 510 may engage the first portion 504 of the nozzle 502, such that the switch 510 can detect that the nozzle 502 is in the closed position.

The nozzle 502 may be moved to the opened position. For example, the second portion 506 of the nozzle 502 may be depressed, such as by applying a downward force to an end (e.g., right end) of the second portion 506 of the nozzle 502. As such, the position of the second portion 506 with respect to the first portion 504 is moved from the closed position to the opened position.

In this example, when the second portion 506 of the nozzle 502 is moved to the opened position with respect to the first portion 504, the material 104 can be dispensed through the opening 508 in the nozzle 502. In addition, in the illustrated opened position, the switch 510 may detect that the nozzle 502 is in the opened position, such as by opening the circuit. Accordingly, the opening of the nozzle 502 can be tracked as a dispense event, since the opening of the nozzle 502 may be indicative of a user dispensing the material 104 through the opening 508. Accordingly, the memory 206 may receive a signal from the switch 510 that is indicative of this dispense event, and store the number of dispense events that have occurred.

After the dispense event has occurred, the user may move the second portion 506 of the nozzle 502 with respect to the first portion 504 from the opened position to the closed position. After the nozzle 502 has been closed, the switch 510 may detect that the nozzle 502 is in the closed position. In such an example, the switch 510 may again transfer a compliance signal or data upon the nozzle 502 being reopened.

To inhibit false positives and/or inadvertent tracking of dispense events, one or more features, structures, devices, or the like may be provided. In one possible example, a timer may be provided as part of the compliance system 520. In such an example, when the nozzle 502 is moved between the opened position and the closed position greater than a predetermined number of times within a predetermined time frame, then the dispense events may not be tracked. Indeed, such a situation may exist when the user is rapidly opening and closing the nozzle 502 for non-dispense event reasons.

This data stored by the memory 206 may be transferred to the remote monitoring device 220 in a similar manner as described above. For example, the transmitter 210 can transmit the wireless compliance signal 230 that is indicative of the number of times the nozzle 502 has been opened (e.g., number of dispense events). This wireless compliance signal 230 can transmit the wireless compliance signal 230 when the remote monitoring device 220 is brought into proximity with the compliance system 520. In such an example, the remote monitoring device 220 can receive the wireless compliance signal 230, whereupon the information related to the number of dispense events can be stored (e.g., within the memory 232), analyzed, or the like.

Although the subject matter has been described in language specific to structural features or methodological acts, it is to be understood that the subject matter defined in the appended claims is not necessarily limited to the specific features or acts described above. Rather, the specific features and acts described above are disclosed as example forms of implementing at least some of the claims.

Various operations of embodiments are provided herein. The order in which some or all of the operations described should not be construed to imply that these operations are necessarily order dependent. Alternative ordering will be appreciated having the benefit of this description. Further, it will be understood that not all operations are necessarily present in each embodiment provided herein. Also, it will be understood that not all operations are necessary in some embodiments.

Many modifications may be made to the instant disclosure without departing from the scope or spirit of the claimed subject matter. Unless specified otherwise, "first," "second," or the like are not intended to imply a temporal aspect, a spatial aspect, an ordering, etc. Rather, such terms are merely used as identifiers, names, etc. for features, elements, items, etc. For example, a first end and a second end generally correspond to end A and end B or two different or two identical ends or the same end.

Moreover, "exemplary" is used herein to mean serving as an example, instance, illustration, etc., and not necessarily as advantageous. As used in this application, "or" is intended to mean an inclusive "or" rather than an exclusive "or". In addition, "a" and "an" as used in this application are generally to be construed to mean "one or more" unless specified otherwise or clear from context to be directed to a singular form. Also, at least one of A and B or the like generally means A or B or both A and B. Furthermore, to the extent that "includes", "having", "has", "with", or variants thereof are used in either the detailed description or the claims, such terms are intended to be inclusive in a manner similar to "comprising".

Also, although the disclosure has been illustrated and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure. In addition, while a particular feature of the disclosure may have been disclosed with respect to only one of several implementations, such feature may be combined with one or more other features of the other implementations as may be desired and advantageous for any given or particular application.

What is claimed is:

1. A dispensing system comprising:

a container within which a material is contained and from which the material is dispensed;

a nozzle attached to the container, the nozzle comprising a first portion and a second portion wherein at least one of the first portion is movable with respect to the second portion or the second portion is movable with respect to the first portion such that a position of the first portion with respect to the second portion is movable between an opened position, in which the material from the container is dispensed through an opening in the nozzle, and a closed position, in which the material from the container is not dispensed through the opening in the nozzle;

a magnet attached to the first portion of the nozzle; and a compliance system attached to the second portion of the nozzle, the compliance system comprising:

a transmitter; and a magnet sensor, coupled to the transmitter, configured to detect a presence of the magnet when the first portion of the nozzle with respect to the second portion of the nozzle is in the closed position, and configured to detect a non-presence of the magnet when the first portion of the nozzle with respect to the second portion of the nozzle is in the opened position;

wherein the transmitter is configured to transmit, to a device, a wireless compliance signal indicative of the magnet sensor detecting at least one of the presence or the non-presence of the magnet.

2. The dispensing system of claim 1, wherein the compliance system comprises memory that is coupled to at least one of the transmitter or the magnet sensor.

3. The dispensing system of claim 2, wherein the memory is configured to store a number of dispense events, wherein a dispense event corresponds to the magnet sensor detecting the non-presence of the magnet.

4. The dispensing system of claim 1, wherein the compliance system comprises a signaling component that is configured to emit a signal when the magnet sensor detects the non- presence of the magnet.

5. The dispensing system of claim 4, wherein the signaling component comprises a light emitting diode.

6. The dispensing system of claim 1, wherein the magnet sensor comprises a Hall effect magnet sensor.

7. The dispensing system of claim 1, wherein the first portion of the nozzle with respect to the second portion of the nozzle is in the opened position when the first portion of the nozzle and the second portion of the nozzle form an angle that is greater than 30°.

8. The dispensing system of claim 1, wherein the wireless compliance signal transmitted by the transmitter comprises an infrared signal.

9. The dispensing system of claim 1, wherein the opening is defined within the first portion of the nozzle.

10. The dispensing system of claim 1, wherein the opening is defined within the second portion of the nozzle.

11. The dispensing system of claim 1, wherein the first portion of the nozzle is connected to the second portion of the nozzle in the closed position and the opened position.

12. The dispensing system of claim 1, wherein the nozzle is removably attached to the container.

13. A kit for converting a dispensing system into a compliance dispensing system, the kit comprising:

a magnet configured to be attached to a first portion of a nozzle of the dispensing system; and a compliance system configured to be attached to a second portion of the nozzle of the dispensing system, the compliance system comprising:

a transmitter; and a magnet sensor, coupled to the transmitter, configured to detect a presence of the magnet when the first portion of the nozzle with respect to the second portion of the nozzle is in a closed position, and configured to detect a non-presence of the magnet when the first portion of the nozzle with respect to the second portion of the nozzle is in an opened position, the first portion of the nozzle connected to the second portion of the nozzle in the closed position and the opened position;

wherein the transmitter is configured to transmit, to a device, a wireless compliance signal indicative of the magnet sensor detecting at least one of the presence or the non-presence of the magnet.

14. The kit of claim 13, wherein the compliance system comprises memory that is coupled to at least one of the transmitter or the magnet sensor.

15. The kit of claim 14, wherein the memory is configured to store a number of dispense events, wherein a dispense event corresponds to the magnet sensor detecting the non-presence of the magnet.

16. The kit of claim 15, wherein the wireless compliance signal transmitted by the transmitter is indicative of the number of dispense events stored by the memory.

17. The kit of claim 13, wherein the compliance system comprises a signaling component that is configured to emit a signal when the magnet sensor detects the non-presence of the magnet.

18. The kit of claim 17, wherein the signaling component comprises a light emitting diode.

19. The kit of claim 13, wherein the magnet sensor comprises a Hall effect magnet sensor.

20. A dispensing system comprising:

a container within which a material is contained and from which the material is dispensed;

a nozzle attached to the container, the nozzle comprising a first portion and a second portion wherein at least one of the first portion is movable with respect to the second portion or the second portion is movable with respect to the first portion such that a position of the first portion with respect to the second portion is movable between an opened position, in which the material from the container is dispensed through an opening in the nozzle, and a closed position, in which the material from the container is not dispensed through the opening in the nozzle;

a switch attached to the second portion of the nozzle, the switch configured to engage the first portion of the nozzle when the second portion of the nozzle with respect to the first portion of the nozzle is in the closed position, the switch not configured to engage the first portion of the nozzle when the second portion of the nozzle with respect to the first portion of the nozzle is in the opened position; and a compliance system attached to one of the first portion of the nozzle or the second portion of the nozzle, the compliance system comprising a transmitter that is coupled to the switch, wherein the transmitter is configured to transmit, to a device, a wireless compliance signal when the switch does not engage the first portion of the nozzle and the nozzle is in the opened position.

* * * * *